US008935871B2

(12) United States Patent
Bardy

(10) Patent No.: US 8,935,871 B2
(45) Date of Patent: Jan. 20, 2015

(54) HAND GUN

(75) Inventor: Alex Bardy, Rishon Lezion (IL)

(73) Assignee: UFB TECHnologies Ltd., Rishon Lezion (IL)

( * ) Notice: Subject to any disclaimer, the term of this patent is extended or adjusted under 35 U.S.C. 154(b) by 0 days.

(21) Appl. No.: 13/550,701

(22) Filed: Jul. 17, 2012

(65) Prior Publication Data

US 2013/0036644 A1 Feb. 14, 2013

(30) Foreign Application Priority Data

Aug. 9, 2011 (IL) ..... 214563

(51) Int. Cl.
*F41A 19/14* (2006.01)
*F41A 3/64* (2006.01)

(52) U.S. Cl.
CPC .. *F41A 19/14* (2013.01); *F41A 3/64* (2013.01)
USPC ..... 42/69.03; 42/70.08

(58) Field of Classification Search
USPC ..... 42/5, 7, 14, 15–20, 69.03, 70.08; 89/196, 197, 147
See application file for complete search history.

(56) References Cited

U.S. PATENT DOCUMENTS

| | | | | |
|---|---|---|---|---|
| 5,293,708 | A * | 3/1994 | Strayer et al. | 42/75.03 |
| 5,669,169 | A | 9/1997 | Schmitter et al. | |
| 6,289,619 | B1 * | 9/2001 | Fuchs et al. | 42/69.03 |
| 6,401,379 | B1 * | 6/2002 | Moon | 42/71.02 |
| 6,993,864 | B1 | 2/2006 | O'Clair et al. | |
| 7,143,538 | B2 * | 12/2006 | LaFleur | 42/70.08 |
| 7,347,022 | B2 * | 3/2008 | Gussalli Beretta | 42/69.01 |

* cited by examiner

*Primary Examiner* — Bret Hayes
*Assistant Examiner* — Joshua Freeman
(74) *Attorney, Agent, or Firm* — Wiggin and Dana LLP; Gregory S. Rosenblatt; Jonathan D. Hall

(57) ABSTRACT

A handgun configured with a hammer insert retained within a rear portion of a frame of the handgun, said hammer insert configured for bearing loads imparted thereto during cocking and firing sequence. And a hammer insert for use in conjunction with a frame of a handheld firearm, the hammer insert configured for sliding insertion into the frame from a rear face thereof, and configured for pivotally supporting a hammer.

18 Claims, 19 Drawing Sheets

HAND GUN

FIELD OF THE INVENTION

This invention relates to improvements in a handgun. More particularly the invention is concerned with a pistol having a body at least partially made of a non-metal material and one or more inserts made of a harder, durable material.

BACKGROUND OF THE INVENTION

In recent years there has been an increase in manufacturing of firearms, in particular pistols, having a frame/body made of injected polymeric components. Such pistols are typically lighter than pistols of same design and however comprising a metal made frame. Yet other advantages of a polymeric body are for example, corrosion resistance, improved grip, etc.

However, to date it is required that some components of the pistol still be made of metal, for example load and pressure bearing components, etc.

One such example is disclosed in U.S. Pat. No. 6,993,864 directed to a front guide mechanism for a compact semiautomatic pistol includes a pair of forward guide rails, which are normally separate from the front guide. Additionally, the front guide includes transverse ribs on the sides of the front guide, which engage mating slots in the polymeric frame of the pistol and secure the block to the frame. The guide rails and transverse ribs are separated by a space or discontinuity on the side wall of the front guide. The guide rails include chamfered front and rear edge surfaces and arcuate, convex bottom surfaces. The above-mentioned features function to create a durable front guide that allows for the construction of a pistol that is more compact than prior art designs.

Another example is disclosed in U.S. Pat. No. 5,669,169 directed to a handgun having a polymeric frame with metallic rails that are inserted within the frame after the frame has been formed by a molding process. The rails are inserted into recesses formed in a channel within the frame, before the frame has completely cooled and contracted. The rails comprise a pair of front rails and a pair of rear rails. The rear pair of rails are positioned within rear recesses and held in place by the sear block. The front pair of rails are positioned within front recesses and held in place by a plurality of metallic parts. The parts include a horseshoe, an unlock block, and a spreader block that are positioned between and matingly engage the front rails, thus securing them within their respective recesses.

SUMMARY OF THE INVENTION

According to the present disclosed subject matter there is provided a handgun with a hammer insert retained within the frame of the firearm and configured for bearing loads imparted thereto during cocking and a firing sequence, in particular forces oriented in a direction normal to a longitudinal, firing axis of the handgun.

The disclosed subject matter calls for a handgun comprising a frame supporting a slide with an associated barrel, and a hammer insert configured for fitting at a rear portion of the frame, said hammer insert configured for pivotally supporting a hammer.

According to another aspect of the disclosed subject matter there is disclosed a hammer insert for use in conjunction with a frame of a handheld firearm, said hammer insert configured for fitting at a rear portion of the frame, said hammer insert configured for pivotally supporting a hammer.

According to yet an aspect of the disclosed subject matter there is disclosed a frame of a handheld firearm configured for receiving a hammer fitted at a rear face of the frame.

Any one or more of the following features, characters and designs can be configured with the firearm subject of the present disclosed subject matter, independently or in combinations thereof:

- The hammer insert is configured for sliding insertion into the frame from a rear face thereof;
- The hammer insert is detachably attachable secured within a receiving portion at a rear of the frame;
- The frame is molded over the hammer insert, such that the hammer insert is fixedly integrated within the rear portion of the frame;
- The hammer insert is configured with depressions and/or protrusions laterally extending from side walls thereof, for fixedly arresting within the frame molded there over and transferring loads from the hammer insert to the frame;
- The frame is made of material softer than steel. According to one particular design the frame is made of polymeric material;
- The frame is fitted with a front guide insert. The front guide insert configured for fixedly arresting within the frame. The front guide insert being removable about an axis substantially perpendicular to a longitudinal axis of a barrel of the firearm;
- When inserted within the frame at a molding process, the hammer insert and a front guide can be a solid, integral unit;
- The firearm is a semi-automatic pistol;
- The firearm is a resembles an original so-called single-stack M1911 model pistol, or a pistol similar thereto;
- The general appearance of the frame is untouched at outside surfaces thereof;
- The hammer inset is made of metal;
- The hammer insert is introduced into a receptacle configured at a rear of the frame and is secured within the frame by one or more securing pins, screws or any suitable fasteners;
- The hammer insert has a rear shape mimicking the corresponding shape of a solid frame firearm, however blending flush with the contour of the firearm, namely with respective portions of the frame and the slide, when the later is at its forward position;
- The hammer insert is configured with bilateral guide rail segments coextensive with bilateral guide rail segments configured at the front guide;
- The hammer insert is configured with a front guide engaging portion, which at an assembled position abuts the front guide about an axis substantially parallel to the axis of the barrel;
- The hammer insert is configured at a front thereof with a front guide arresting portion, which at an assembled position can engage a corresponding arresting portion of the front guide, such that the front guide and the hammer insert a become uniform member, substantially eliminating axial displacement therebetween.
- Arresting between the front guide and the hammer insert can take place by a male portion downwards projecting at a rear bottom portion of the front guide and configured for arresting within a corresponding female portion at a top front portion of the hammer insert. The hammer insert is configured with a frame positioning and engaging fitting cooperating with a corresponding hammer insert positioning and arresting fitting. The frame positioning and engaging fitting is configured as a pair of lateral groves or lateral projecting shoulders and the hammer insert positioning and arresting fitting is configured as an other one of said pair of lateral groves or lateral projecting shoulders;

The hammer insert is configured for sliding positioning within the frame and is displaceable about an axis substantially parallel to the axis of the barrel ('firing axis');

The hammer insert is secured to the frame by one or more fasteners extending about an axis perpendicular to the axis of the barrel;

The one or more fasteners extend through hand grips of the firearm. Said handgrips being removable or integrally molded with the frame;

The hammer of the firearm is pivotally coupled to the hammer insert;

The hammer insert is configured for bearing loads imparted thereto by the hammer (and in turn by the stirrup/strut and the associated hammer spring) along an axis transverse the axis of the barrel;

The hammer insert pivotally accommodates a disconnector of the firearm.

BRIEF DESCRIPTION OF THE DRAWINGS

In order to understand the invention and to see how it may be carried out in practice, an embodiment will now be described, by way of non-limiting examples only, with reference to the accompanying drawings, in which:

FIGS. 6A to 6D illustrated a front guide and hammer insert couple according to a modification of the present disclosed subject matter, wherein:

FIG. 6A is an isometric view of the modified front guide;

FIG. 6B is an isometric view of the modified hammer insert;

FIGS. 6C and 6D are a side view and an isometric view of the front guide and hammer insert couple;

DETAILED DESCRIPTION OF EMBODIMENT

Attention is first directed to FIGS. 1 and 2 of the drawings illustrating a semi-automatic pistol generally designated 10, being a so-called M1911 model pistol, though not restricted to the specified type.

Pistol 10 comprises a frame 14 (at times also referred to as a 'body') generally comprises a slide receiving portion (often referred to as a 'dust cover') 16 and a hand grip portion 18, and is typically made of solid polymeric material. Whilst in the present example the body is made of polymeric material, it is appreciated that the disclosed subject matter is suited for implementing in any body made of a softer than metal material. A polymeric molded frame renders manufacturing cheaper than conventional machining processes.

Figure 1A:
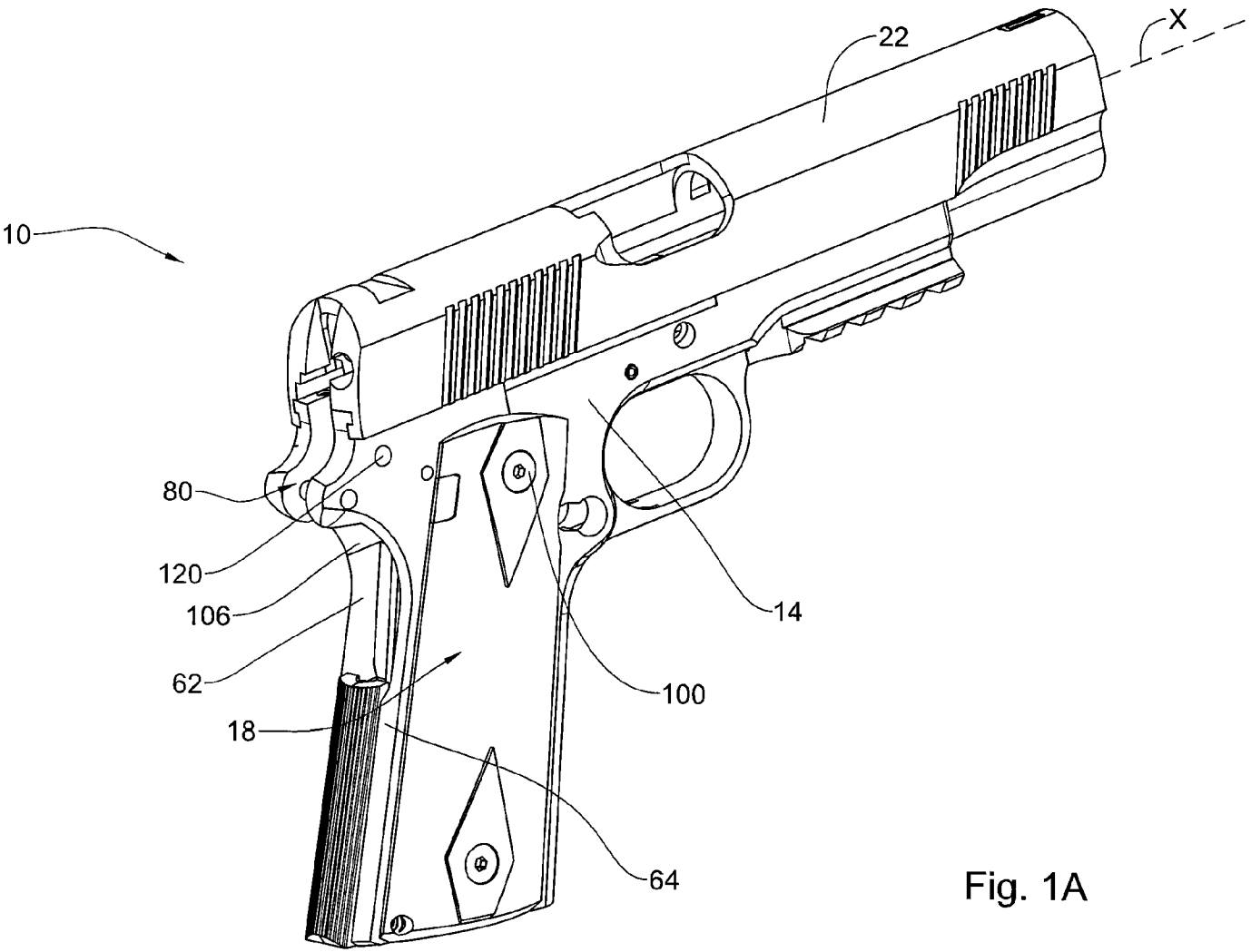
FIG. 1A is a rear-right side perspective view of a pistol in accordance with the present disclosed subject matter.
Figure 1B:
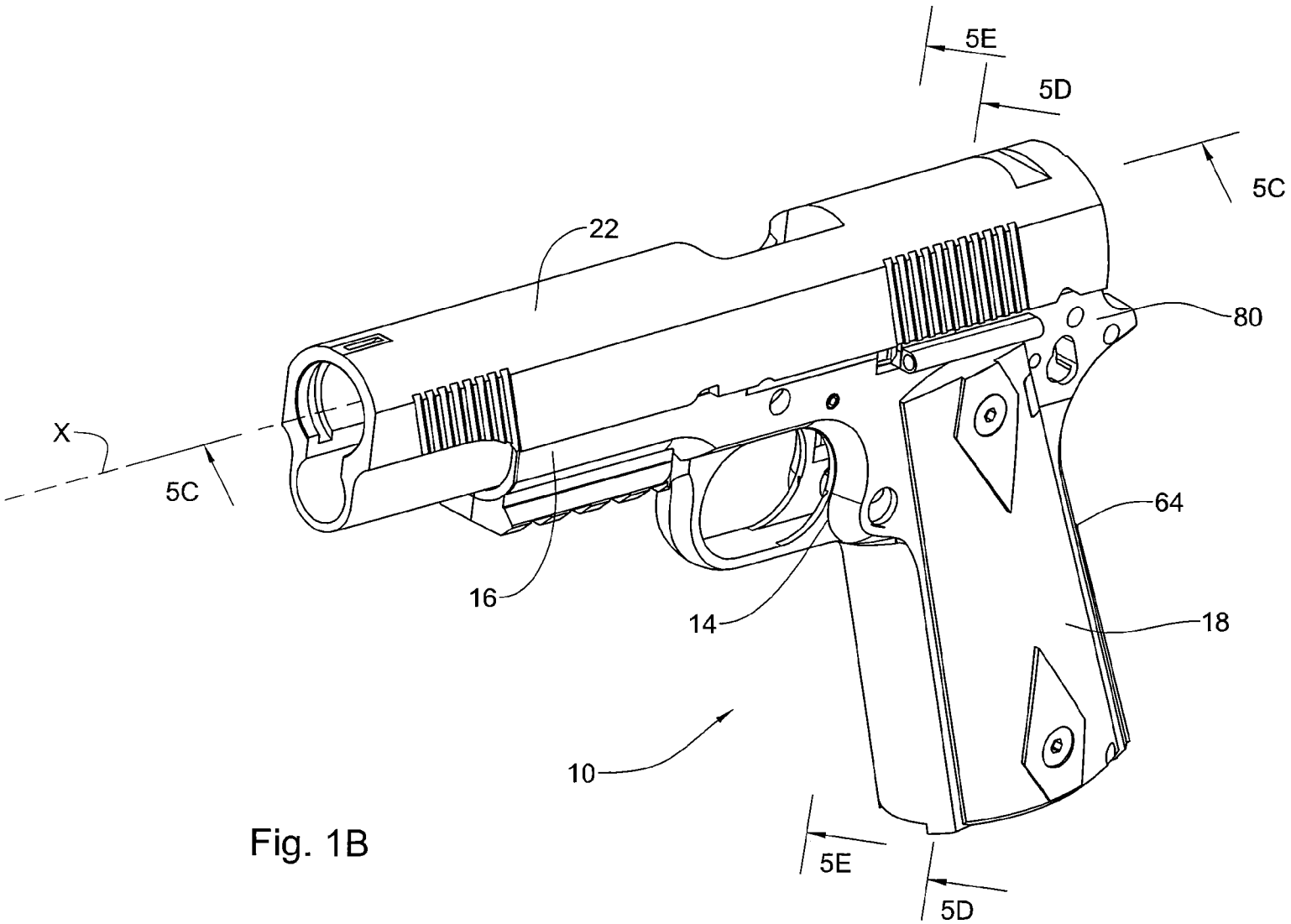
FIG. 1B front-left side perspective view of the pistol seen in FIG. 1A.
Figure 1C:
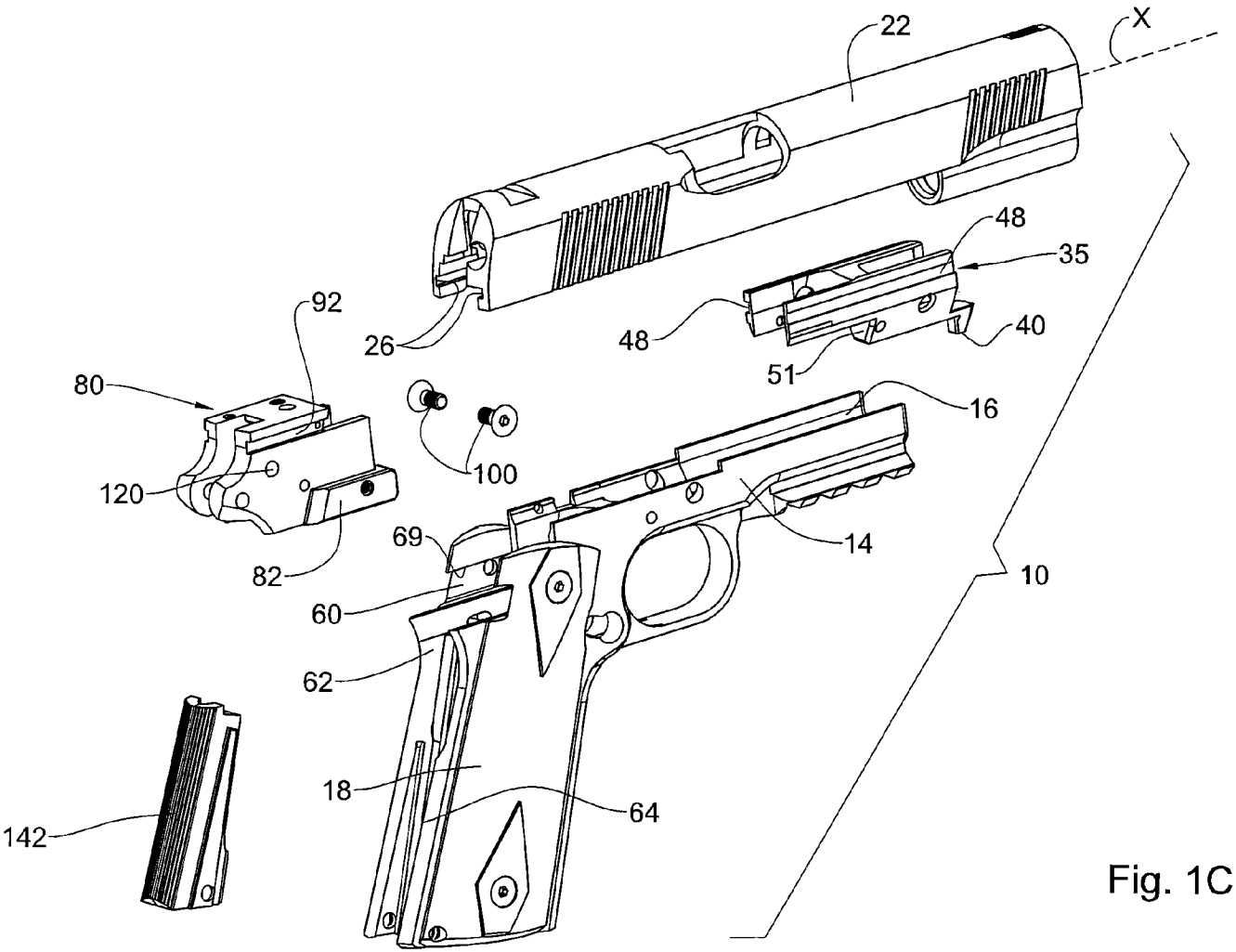
FIG. 1C is an exploded rear isometric view of the pistol illustrated in FIG. 1A.
Figure 1D:
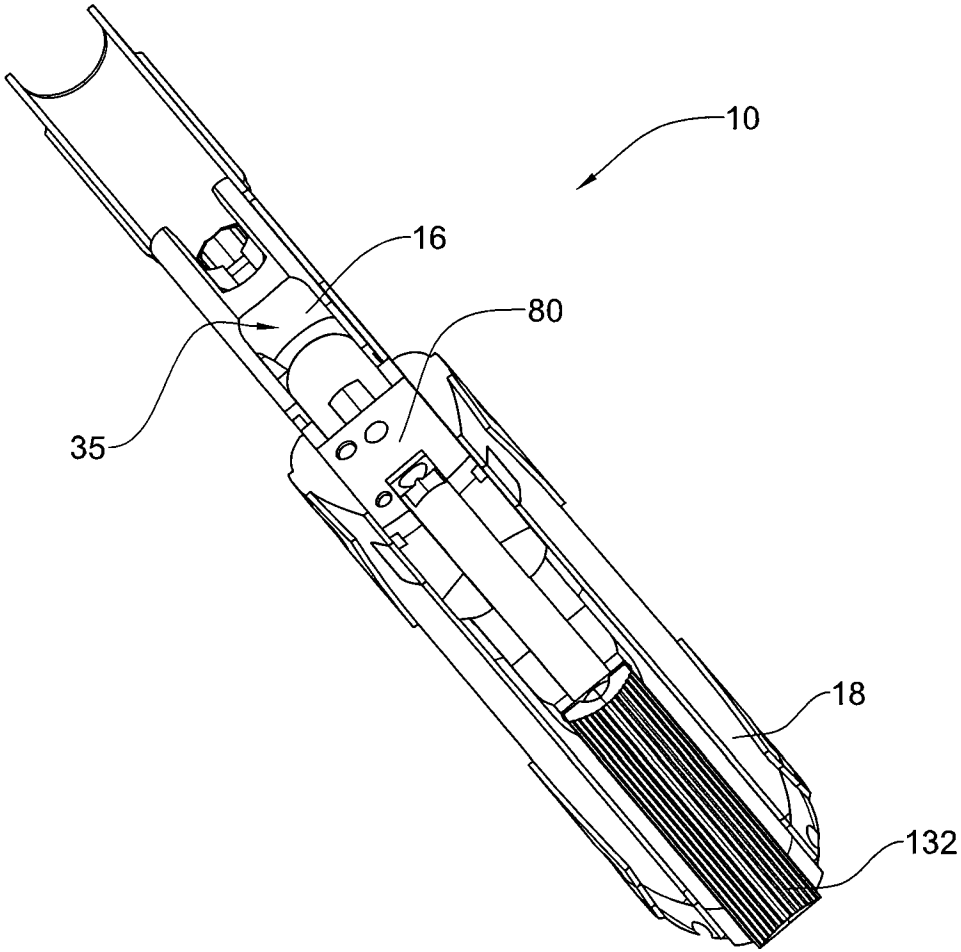
FIG. 1D is a top-rear perspective view of the pistol with the slide barrel and some other components removed, for the sake of clarity.
Figure 2A:
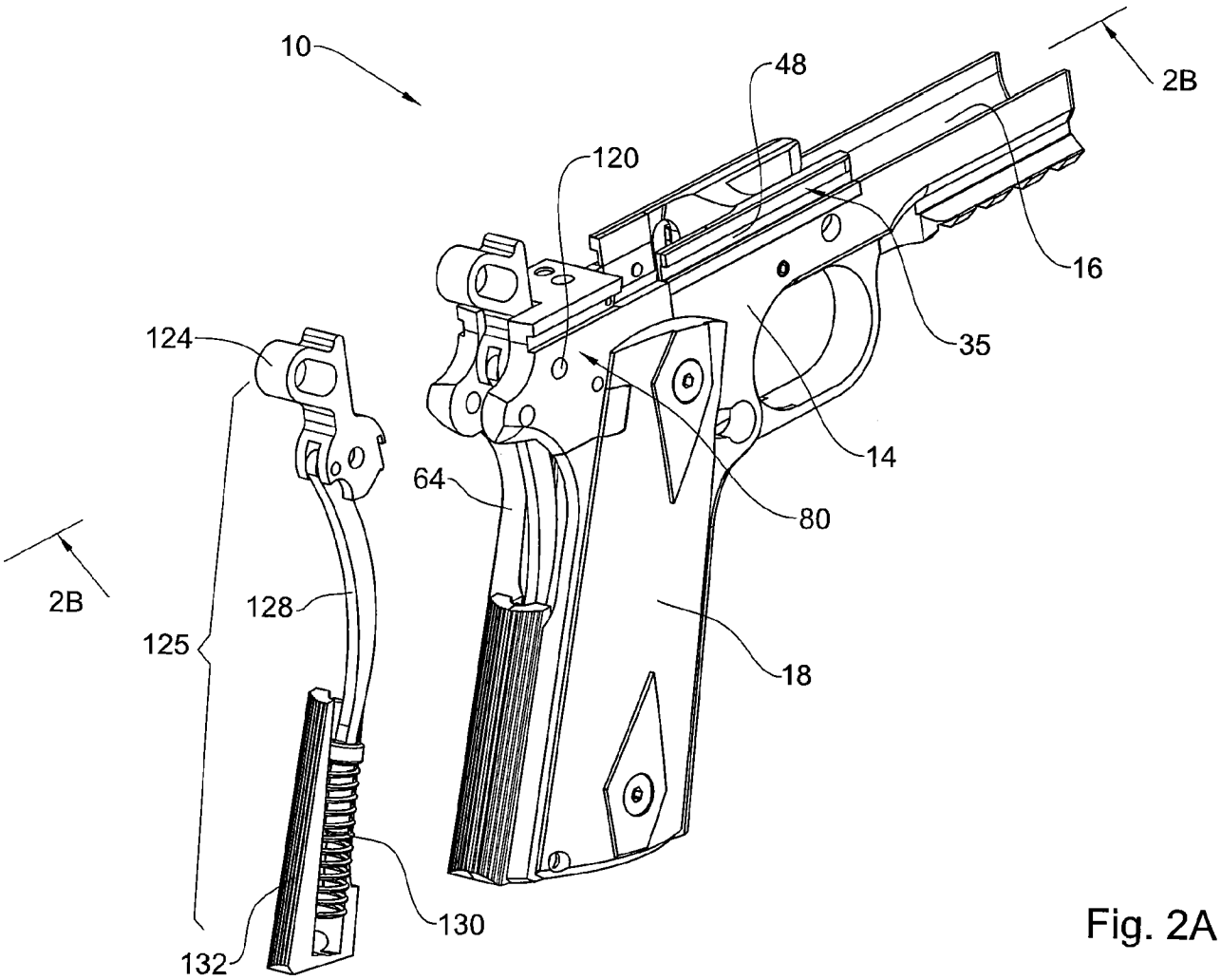
FIG. 2A is a rear-right perspective view of the pistol at its non-cocked position, with several components, and with the hammer mechanism illustrated side-by-side for sake of clarity.
Figure 2B:
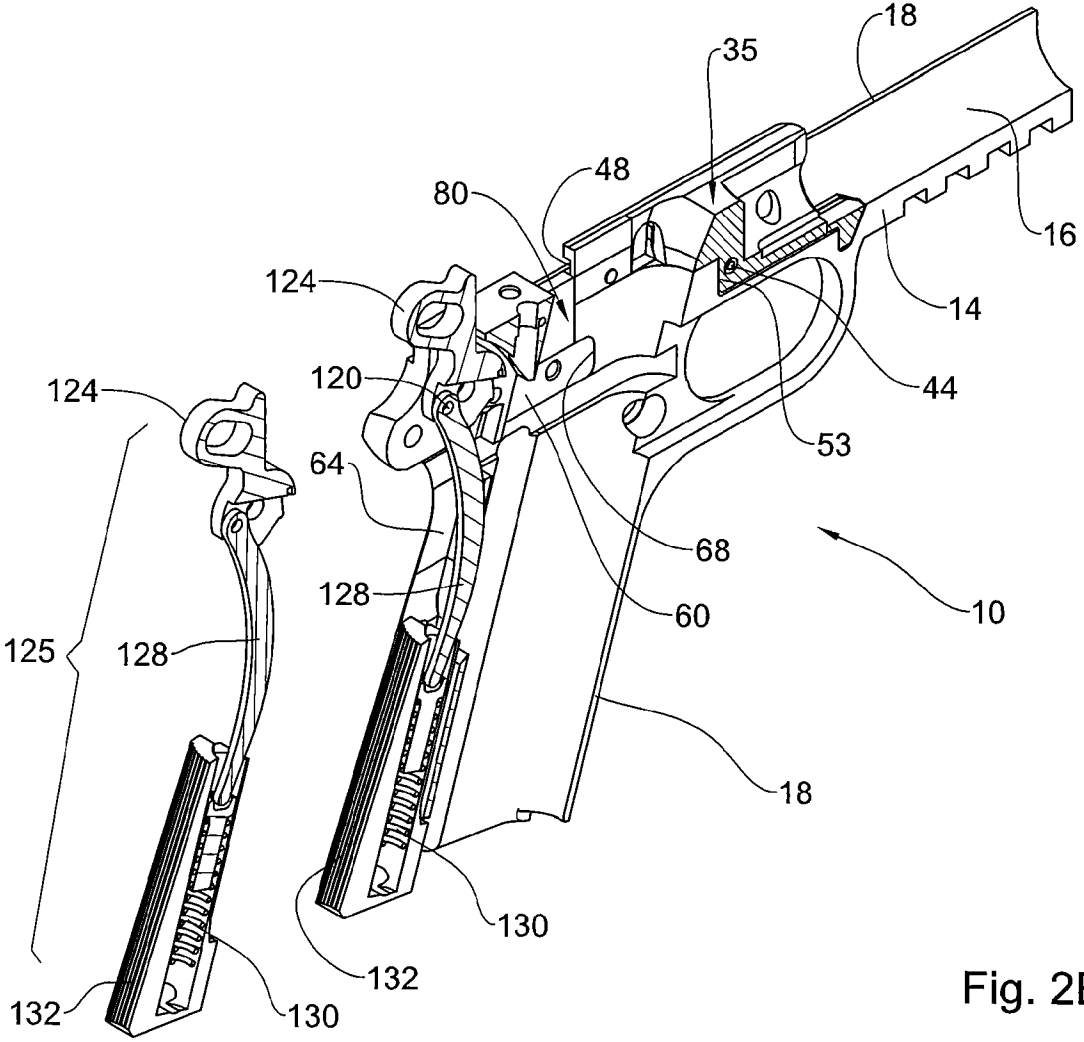
FIG. 2B is a section along line 2B-2B in FIG. 2A.
Figure 2C:
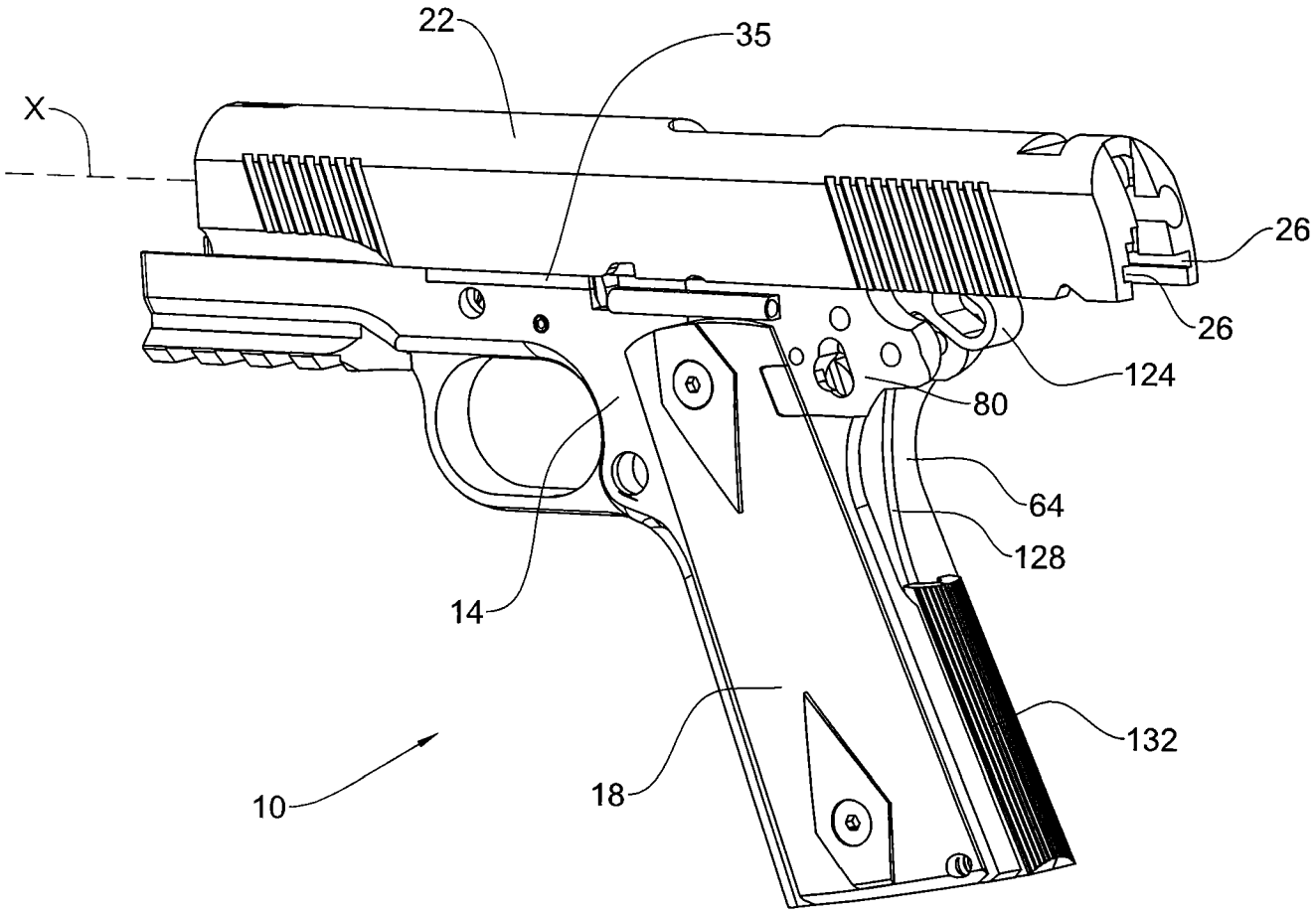
FIG. 2C is a rear-left side isometric view of the pistol at its cocked position, with the slide at a rear position thereof.
Figure 2D:
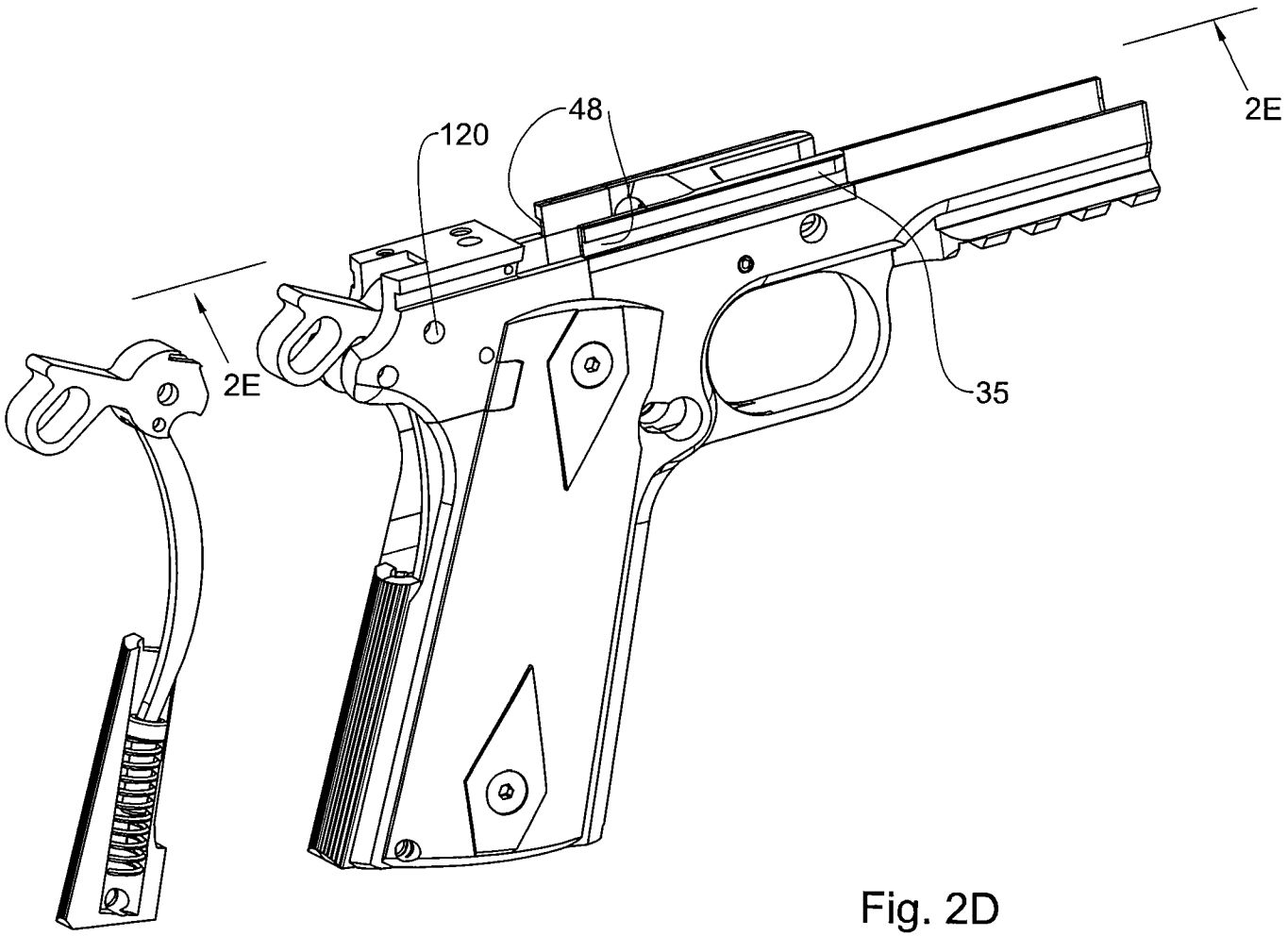
FIG. 2D is a rear-right side isometric view of the pistol of FIG. 2C, with the slide and other components removed.
Figure 2E:
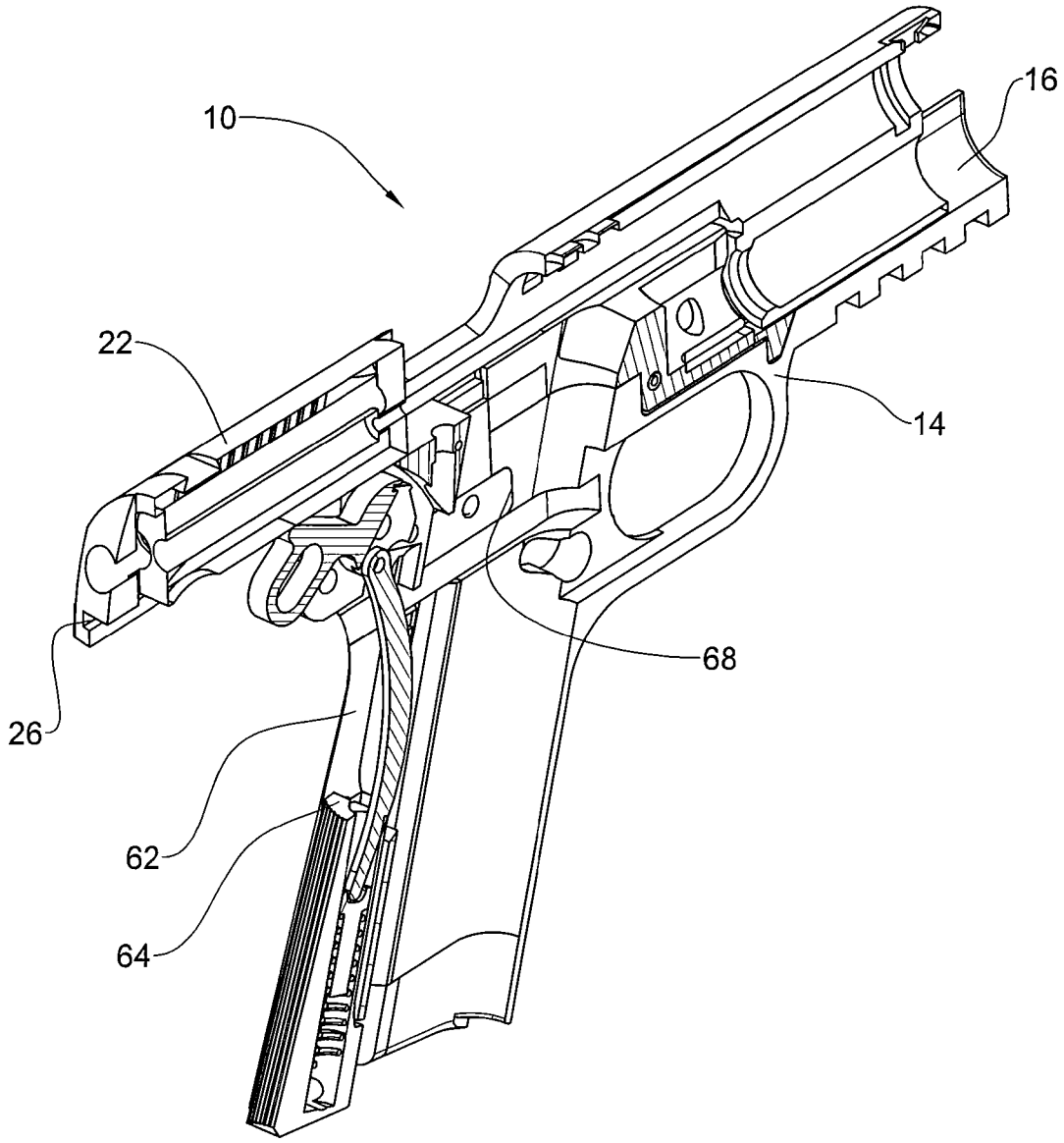
FIG. 2E is a longitudinal section along line 2E-2E in FIG. 2D.
Figure 3A:
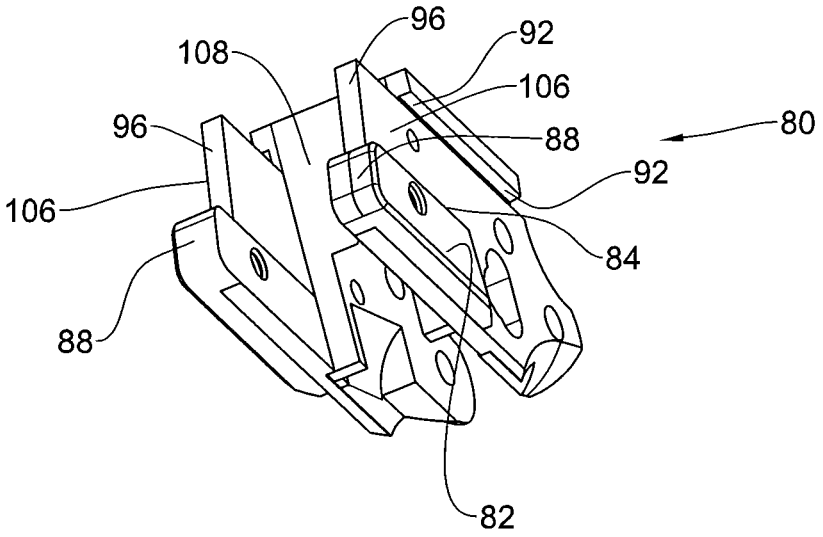
FIG. 3A is a bottom/front isometric view of a hammer insert in accordance with the present disclosed subject matter.
Figure 3B:
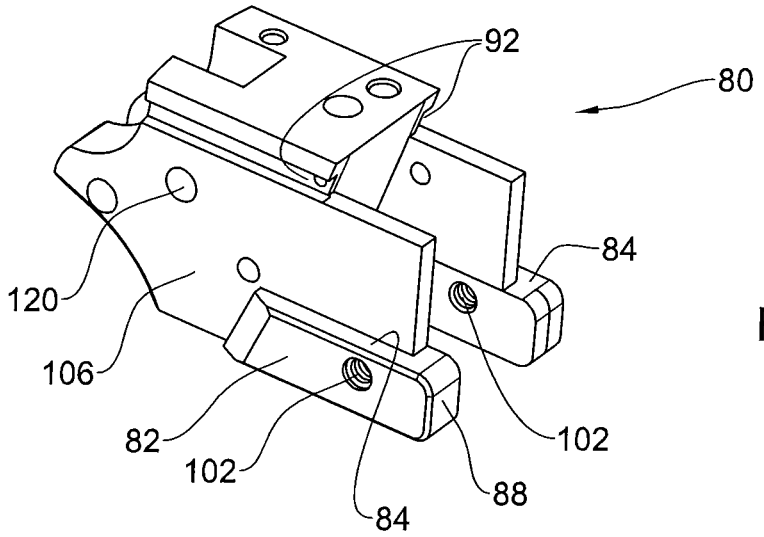
FIG. 3B is a top-front view of the hammer insert.
Figure 3C:
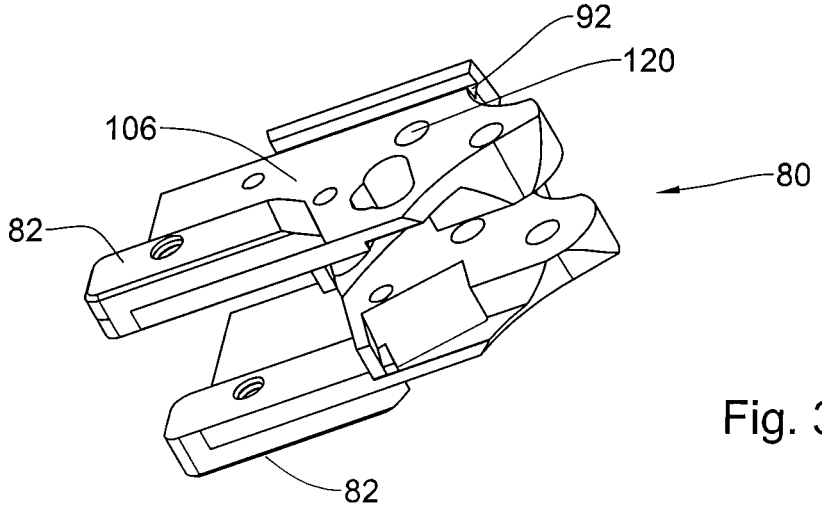
FIG. 3C is a bottom-left perspective view of the hammer insert.

The slide receiving portion 16 accommodates a slide 22 reciprocally secured at a top portion of the frame 14 and displaceable between a normal ('front') position (FIGS. 1A and 1B) and a cocked, rearward position (FIG. 2C). A barrel (not shown) is received within the slide 22 and defines a longitudinal axis X of the barrel 20, namely the firing axis. Other components of the pistol, associated with the firing mechanism, safety mechanism and so on are received within the frame 14 and slide 22 and are not illustrated.

Figure 4A:
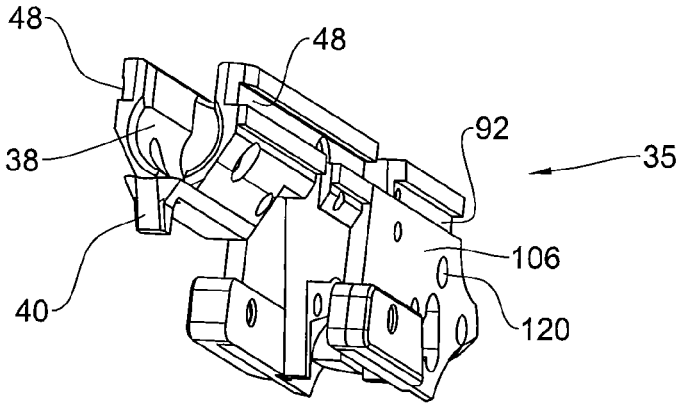
FIG. 4A is a front bottom perspective view of the hammer insert engaged with a front guide insert.

The slide 22 is configured with a pair of longitudinally extending grooves 26 (FIG. 1C) configured for slidingly engaging over longitudinal guide rails bilaterally extending along a front guide and a hammer insert, as will be discussed hereinafter, thus facilitating smooth reciprocal displacement of the slide 22 along an axis substantially parallel to a longitudinal axis X The pistol 10 is further provided with a front guide 35 in the form of a metal insert (typically steel) embedded within the slide receiving portion 16 of frame 14, and having a substantially U-shaped front opening 38 (FIG. 4A) configured for receiving a recoil spring and the associated recoil spring guide (not shown) and acting as a stop for the slide 22 during its recoil at a firing instance.

Figure 4B:
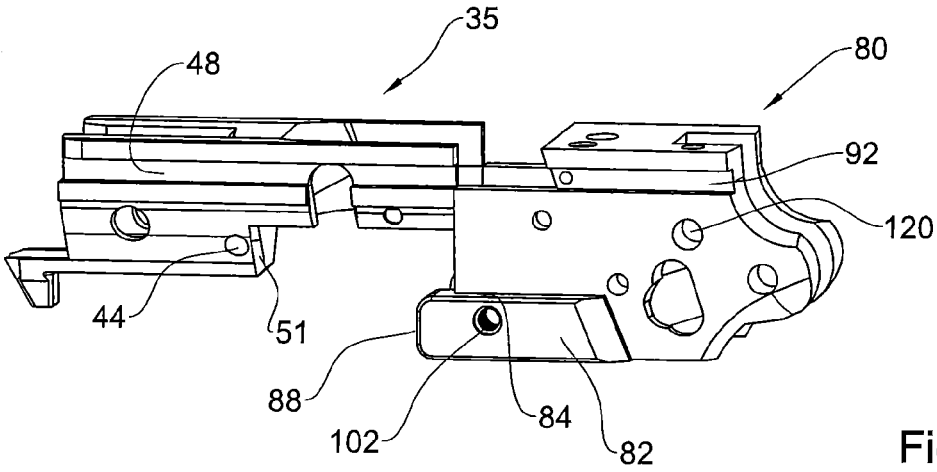
FIG. 4B is a left side view of the assembly configured in FIG. 4A.
Figure 4C:
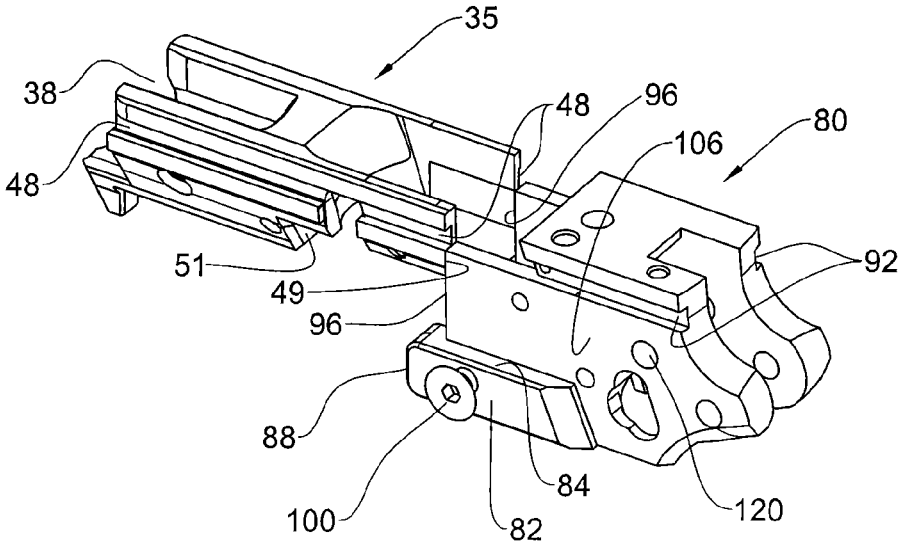
FIG. 4C is a top-left perspective view of FIG. 4A.
Figure 5A:
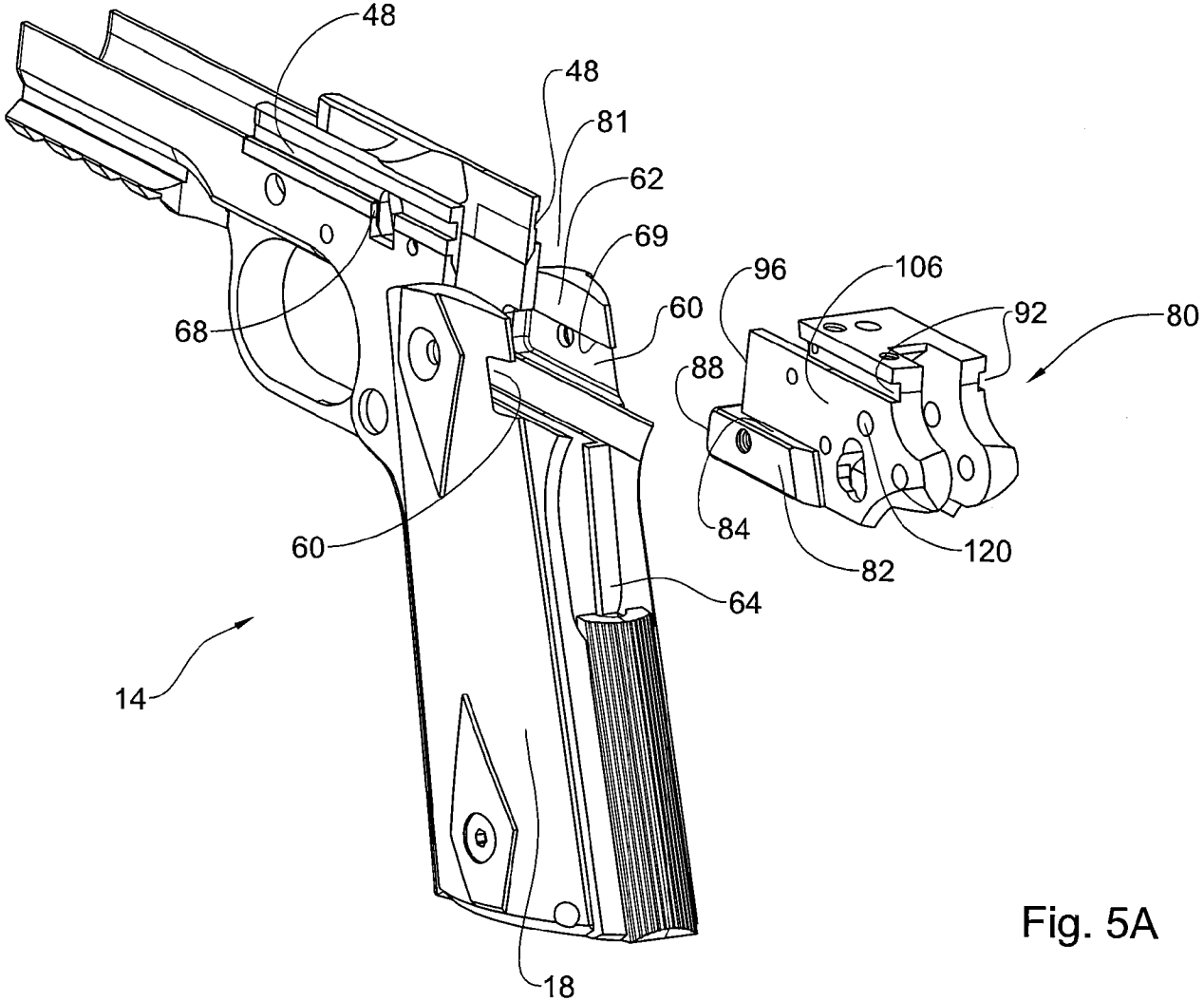
FIG. 5A is a rear-left perspective view of the pistol, with the slide and barrel removed, and the hammer insert exploded out.
Figure 5B:
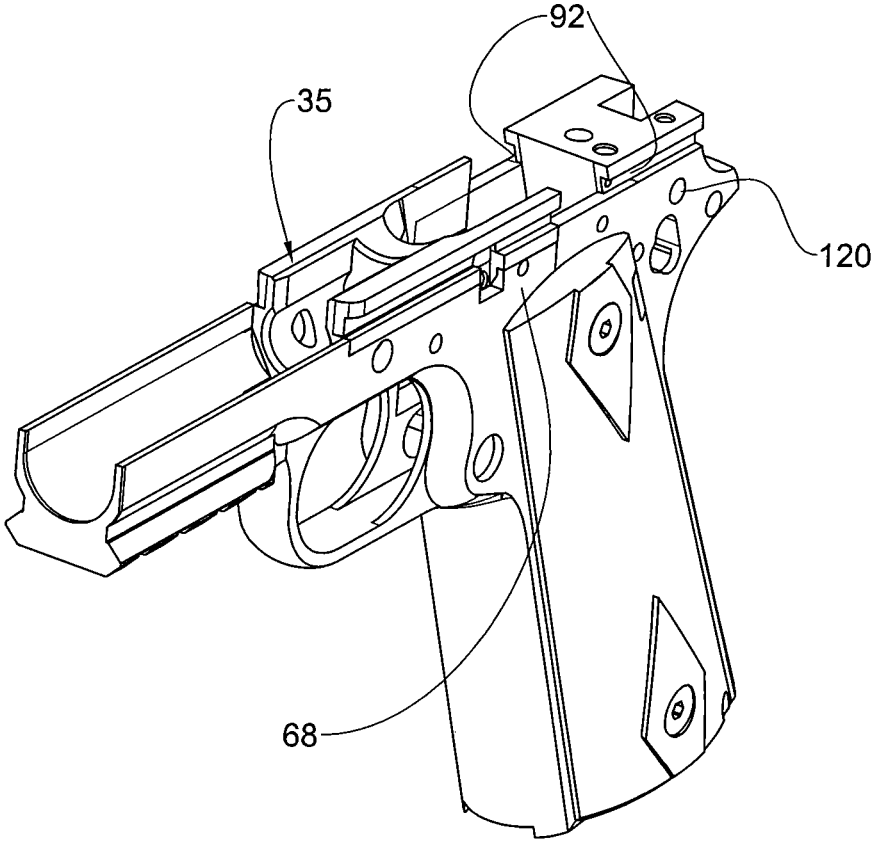
FIG. 5B is a front-left perspective view of the pistol, with the barrel and slide removed and the frame made semi-transparent.
Figure 5C:
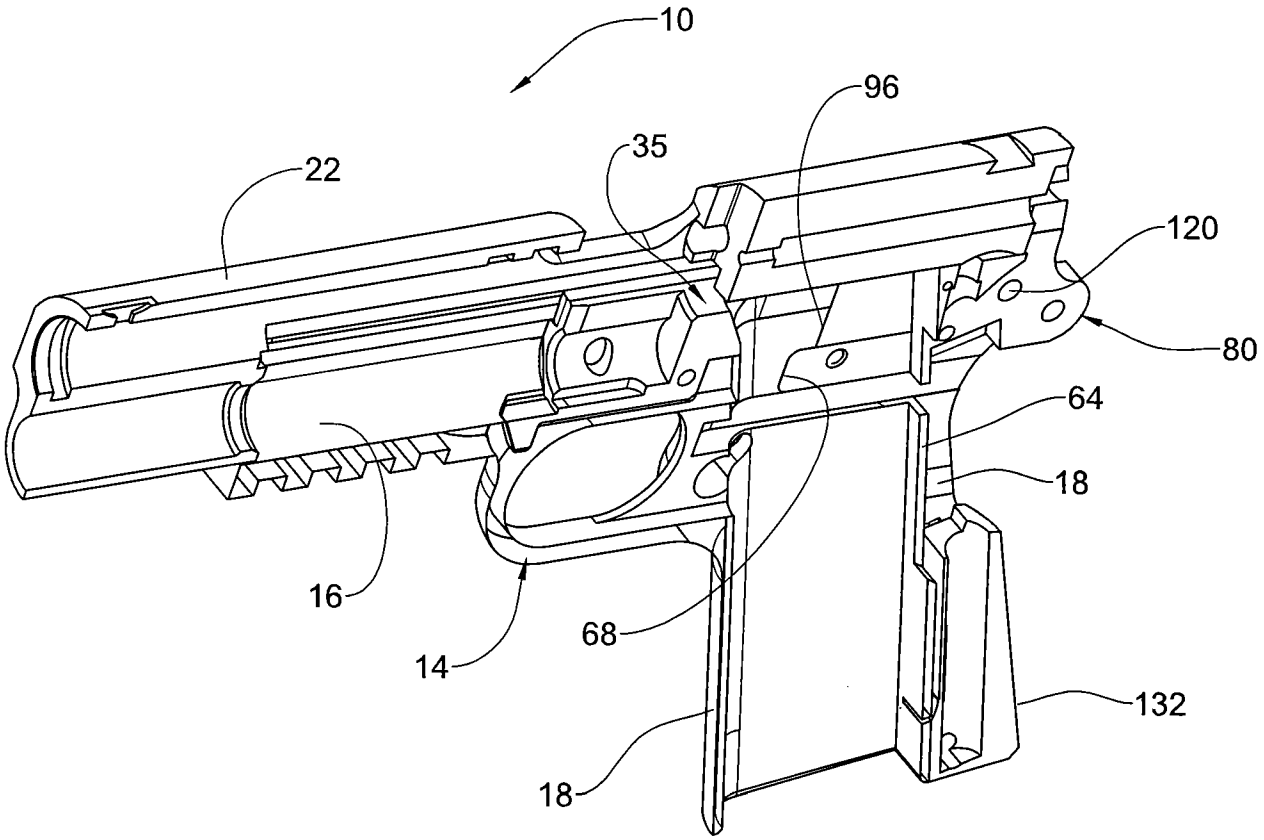
FIG. 5C is a longitudinal section along line 5C-5C in FIG. 1B.
Figure 5E:
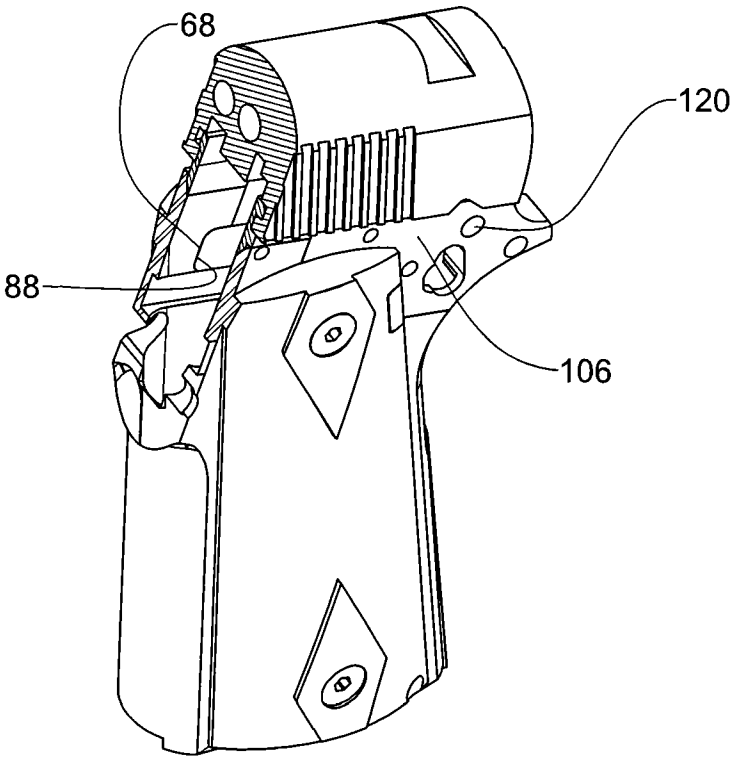
FIG. 5E is a section taken along line 5E-5E in FIG. 1B.
Figure 5D:
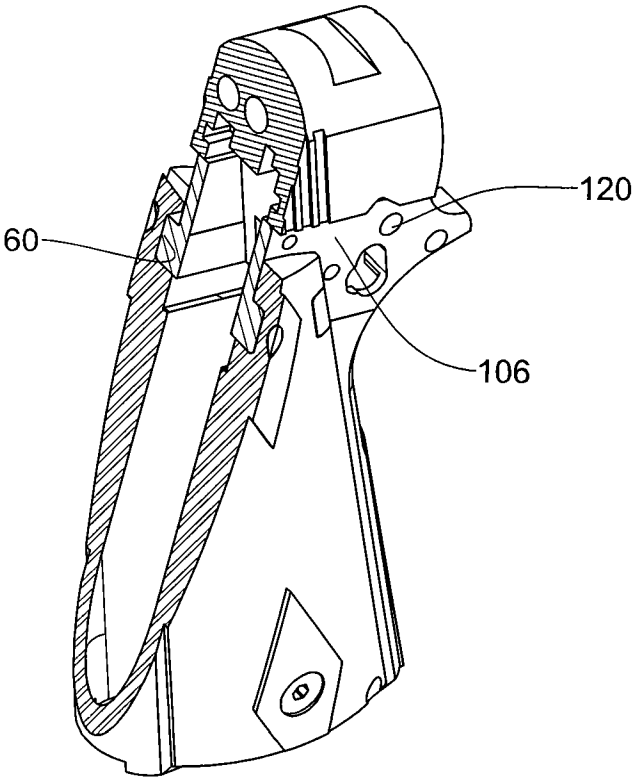
FIG. 5D is a section taken along line 5D-5D in FIG. 1B.
Figure 6A:
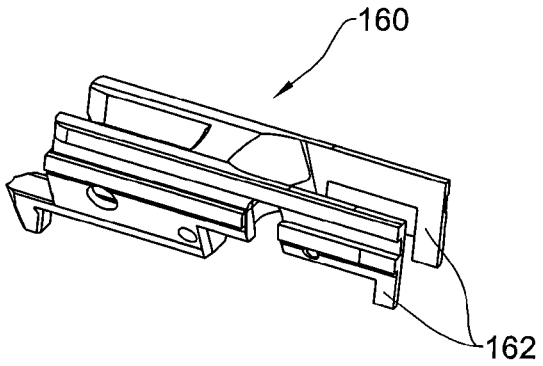
Figure 6B:
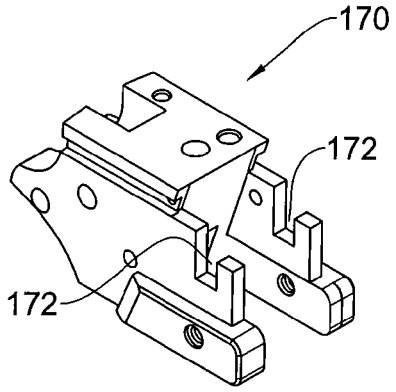
Figure 6C:
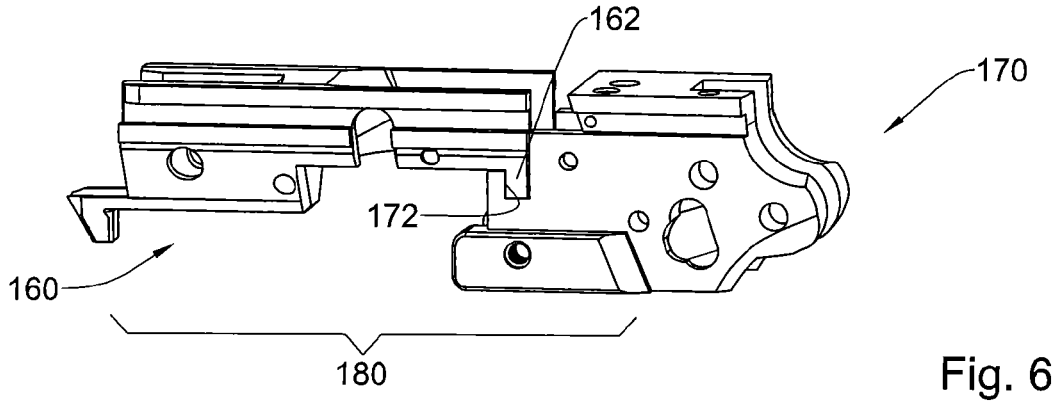
Figure 6D:
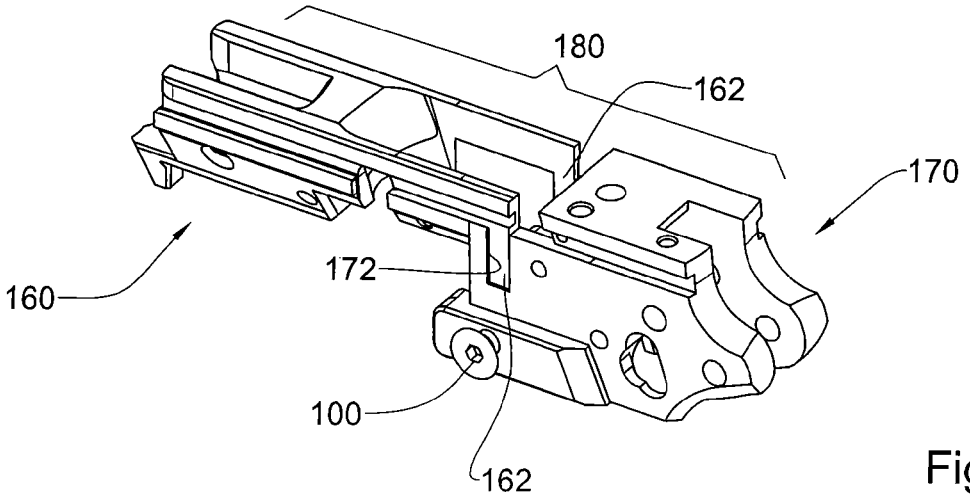
Figure 7:
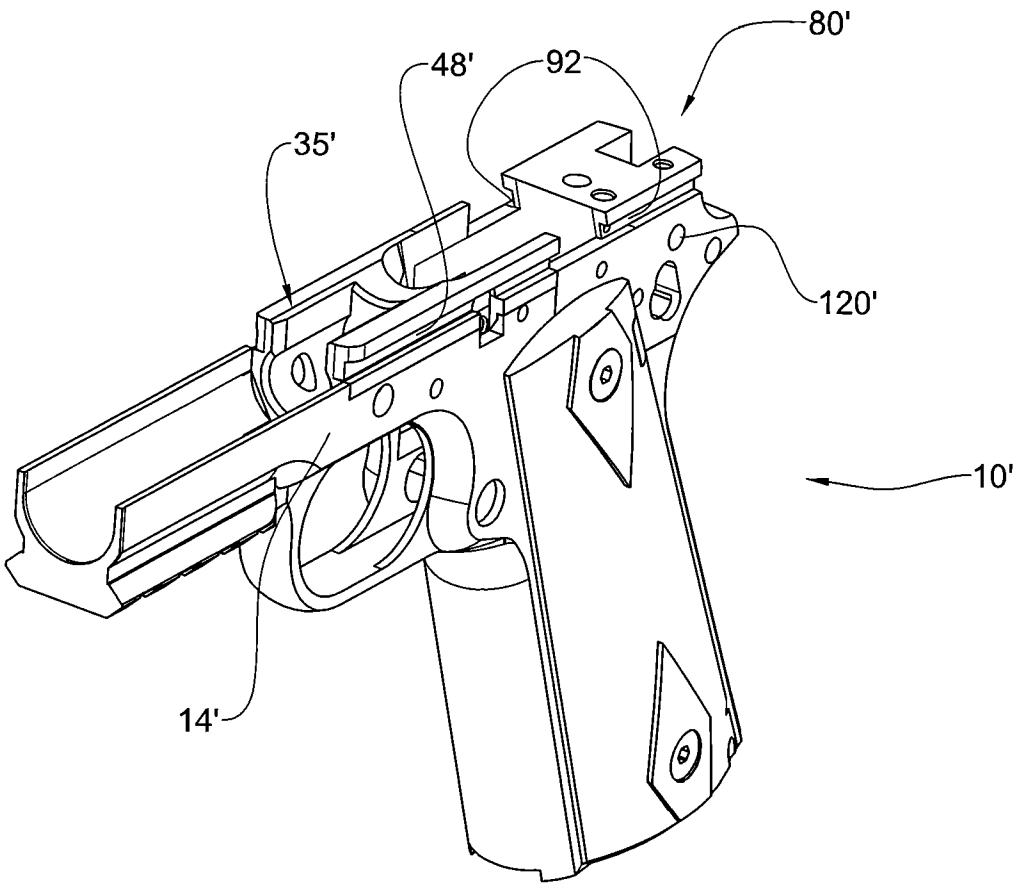
FIG. 7 is a front-left perspective view of the pistol according to a modification thereof, with the barrel and slide removed.
Figure 8:
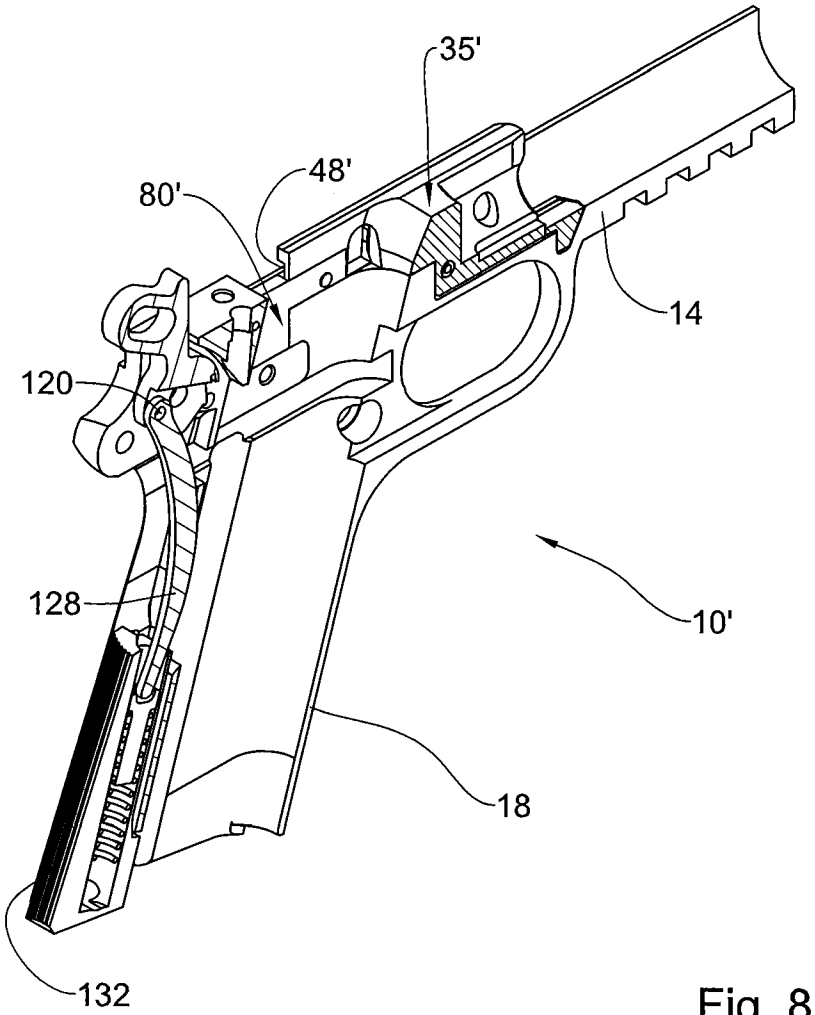
FIG. 8 is a mirror image of FIG. 7, longitudinally sectioned.

Recoil forces borne by the front guide insert 35 are transferred to the frame 14 by a projection 40 projecting downwards into a cavity configured in the frame and further by rearwards facing surface 51 (best seen in FIG. 4B), bearing against a corresponding surface 53 (best seen in FIG. 2B) within the frame 14, such that any forces developing during the course of firing along the axial direction are directed to and borne by the frame 14.

Front guide pins (not shown) extend through the frame 14 and through respective apertures 44 extending through the front guide insert 35 traversing the longitudinal axis X, for arresting the front guide within the frame and prevent its displacement.

As can further be seen, the front guide insert 35 is configured at its top with two bilateral external grooves 48 providing smooth reciprocal displacement of the slide 22 there along.

It is noted that the front guide insert 35 is inserted and removed from the frame 14 along a substantially vertical path i.e. perpendicular to the longitudinal axis X, such that the front guide insert is received within a basin configured within the frame 14. A rear wall 51 of the front guide insert 35 bearing against a corresponding wall 53 portion of said basin of the frame, for bearing a majority of axial forces developing during a firing sequence.

Frame 14 is further configured at a rear end thereof, at a top portion of the handgrip portion 18, with a pair of parallely extending insert grooves 60 extending substantially parallel to the longitudinal axis X of the firearm. The grooves 60 extend from an opening 62 at a rear face 64 of the frame 14 and terminate at a front stopper wall portion 68.

A hammer insert generally designated 80 is made of a hard and durable material, typically steel, is configured for slidingly insertion into the frame 14 and is provided with a pair of laterally projecting shoulders 82 shaped and sized for snugly receiving within the hammer insert grooves 60 and configured with a top wall surface 84 configured for bearing flush against a corresponding wall surface 69 of the hammer insert groove 60. The shoulders 82 are further configured with a fore-end wall surface 88 which at the assembled position bears against the stopper wall portion 68 of the grooves 48 of frame 14. It is noted that the shoulders 82 have substantive top and bottom surface area, which at the assembled position extend flush against corresponding surfaces of the grooves 60 at the rear of frame 14, such that loads directed in a substantially vertical orientation (i.e. transverse to longitudinal axis X) are directed to and born by the frame.

Further noted, the hammer insert 80 is configured at a top thereof with a pair of parallely extending side rails 92 which at the assembled position coextend with the grooves (guide rails) 48 of the front guide insert 35 (FIGS. 4A-4C and 5A). As can further be seen, the hammer insert 80 is configured at its front with a substantially flat upright extending wall 96 configured such that at the assembled position it extends flush against a rear wall portion 49 of the front guide insert 35, thus extending at a surface to surface contact. It is however pointed out that contact between the front guide insert 35 and the hammer insert 80 can be avoided by shortening one or both of rear portion of the front guide insert 35 and the front portion of the hammer insert 80, thereby eliminating transfer of axial forces to the hammer insert 80.

The hammer insert 80 is fixedly secured within the frame 14 by a pair of bolts 100 extending through the hand grips and through the hand grip portion 18 (which in the present example said grips are integrally molded with the frame, though the handgrips may be detachably attached to the frame), and are screwed into threaded bores 102, whereby the hammer insert 80 becomes fixedly arrested within the frame 14, though removable if so desired, e.g. for maintenance and the like.

It can further be seen that two sidewalls 106 of the hammer insert 80 are substantially parallel to one another and are flat wall surfaces configured for snugly receiving within the hammer insert space 81 configured at the rear of the frame 14. It is seen that the side walls 106 are partially received within the rear body opening 62 and partially are exposed and constitute an external surface coextensive with the frame.

A space 108 extending between the walls 106 accommodates top portion of a magazine, when introduced into the handgun.

The hammer insert 80 is provided with several bores extending through sidewalls 106 and traversing the longitudinal axis of the firearm. Said openings serve for securing articulated mechanisms, e.g. trigger, firing mechanism, safety mechanism, etc. however, opening 120 is a hammer opening configured for pivotal supporting of the hammer 124 being part of the hammering mechanism 125.

Hammer 124 is pivotally secured within the hammer insert 80 by means of a hammer pin (not shown) extending through the sidewalls 106 of the hammer insert 80, through openings 120. Another pin serves for pivotal coupling of a hammer strut 128 partially received within and being loaded by a hammer spring 130, said spring being a coiled spring bearing at its bottom end against a hammer spring housing 132 secured within the frame 14.

Loads imparted to the hammer 124 during a recoil operation and at the instance of firing the pistol or releasing the hammer, extend at a substantially vertical direction, namely substantially vertical to the longitudinal axis X of the firearm 10, said loads being borne by the hammer insert 80.

The arrangement disclosed hereinabove facilitates manufacturing of the firearm frame of a softer then metal materials (i.e. non-metal materials), e.g. polymeric material, with the provision of metallic inserts, namely the front guide insert and the hammer insert configured for bearing significant loads developing during a firing sequence, which otherwise could not be borne by a polymeric (or any other non-metal) frame.

Further attention is now directed to FIGS. 6A to 6D directed to a modification of the present disclosed subject matter, wherein the front guide generally designated 160 and the hammer insert generally designated 170 are engaged creating an axially bound couple generally designated 180.

According to this example, the front guide 160 has at a rear portion thereof a pair of downwards facing projections 162 and the hammer insert 162 is configured at front portion thereof with a pair of corresponding arresting receptacles 172, sized for snugly arresting the projections 162 of the front guide 160.

Assembly of the couple 180 takes place by first slidingly inserting the hammer insert 170 into the frame of the pistol from its rear opening 60, as disclosed herein above, substantially parallel to the longitudinal axis X, and then only the front guide 160 is introduced into the slide receiving portion 16, in a vertical direction, and positioned so that the projections 162 become arrested within the arresting receptacles 172, whereby the front guide and the hammer insert become axially integrated, i.e. eliminating axial displacement therebetween. In the heretofore examples the hammer insert was configured for sliding insertion into the frame from a rear face thereof and is detachably attachable secured within a receiving portion at a rear of the frame. In accordance with another aspect of the disclosed subject matter the hammer insert as disclosed in FIGS. 7 to 10, the frame is molded over the hammer insert, such that the hammer insert is fixedly integrated within the rear portion of the frame.

For sake of clarity, like elements are designated with same reference numerals, however with a ' indication.

Figure 9A:
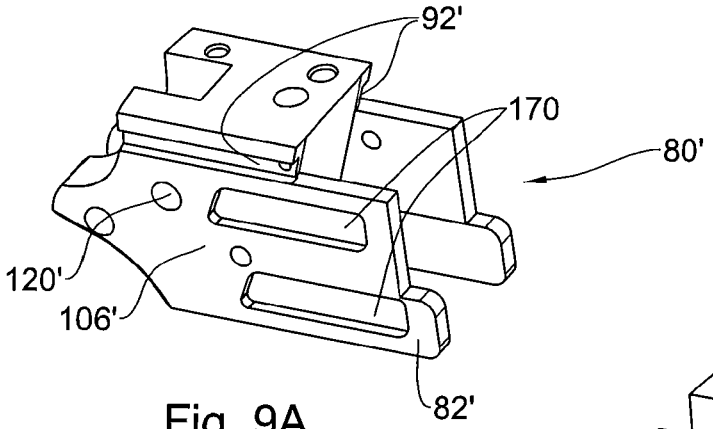
FIGS. 9A to 9C are isometric views of alternate examples of a hammer insert, suited for integrally molded with the frame.
Figure 9B:
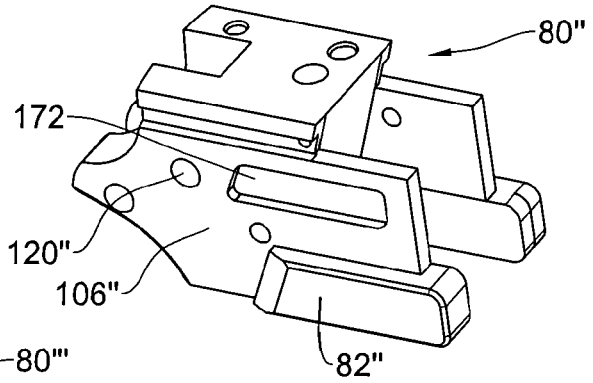
Figure 9C:
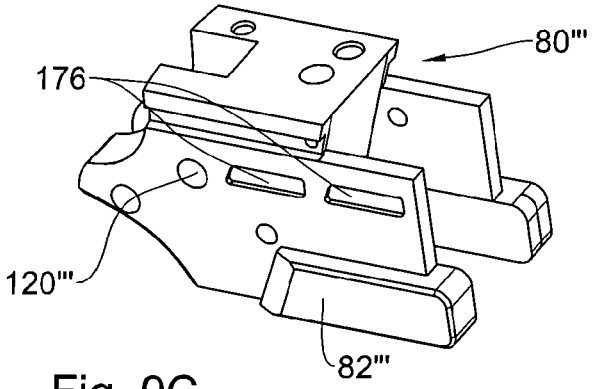

Noting that the frame 14' is made of a moldable material, it is molded over the hammer insert 80' in a fashion such that on the one hand it does not alter the functionality nor the appearance of the handgun 10', and on the other hand the hammer insert 80' becomes integrated within the frame 14'. This is facilitated by imparting the side walls 106' of the hammer insert 80' with depressions 170 (FIG. 9A) whereupon over-molding the frame 14' there over, molten material flows into said depressions whereby the hammer insert 80' becomes integrated with the frame. In the example of FIG. 9B the side walls 160" hammer insert 80" are configured with a depression 172 and with a lateral projection 82', and in the example of FIG. 9C the side walls 160'" hammer insert 80'" are configured with a major lateral projection 82'" and smaller lateral projections 176.

The lateral projections and/or the depressions formed on the side walls of the hammer insert facilitate for arresting the hammer insert within the frame and transferring loads from the hammer insert to the frame.

Figure 10:
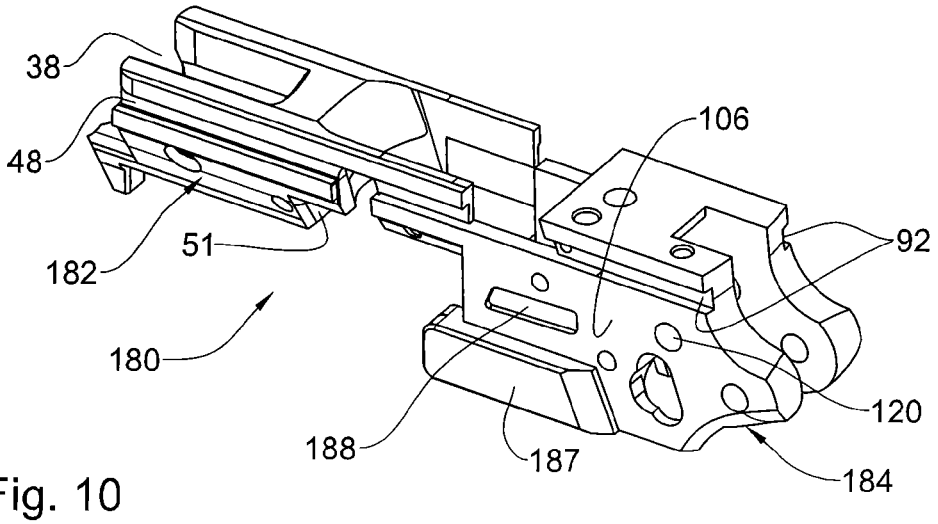
FIG. 10 is an isometric view of a combined front guide and hammer insert, suited for integrally molded with the frame.

In FIG. 10 there is illustrated a solid hammer insert and a front guide generally designated 180, integrally configured with a front guide portion 182 and a hammer insert portion 184. The arrangement is such that the frame of the handgun is over-molded over the solid unit 180, rendering it a solid configuration competent for bearing loads in both an axial direction (parallel to the longitudinal axis of the handgun) and at a transverse axis (normal to said longitudinal axis). A plurality of lateral projections 187 and/or the depressions 188 can be configured on the side walls to thereby increase integration and consolidation of the frame over the solid unit 180, also improving load bearing.

The invention claimed is:

1. A handgun, comprising:

a hammer insert retained within a rear portion of a frame of the handgun;

wherein said frame includes a hand grip portion and a slide receiving portion;

said hammer insert being configured for bearing loads imparted thereto during cocking and firing sequence;

wherein the hammer insert comprises a pair of laterally projecting shoulders having a direction of extension that is substantially parallel to a longitudinal axis of a barrel of the handgun; and wherein the rear portion of the frame comprises parallelly extending insert grooves configured to slidingly receive the laterally projecting shoulders of the hammer insert to extend substantially flush against the insert grooves and to transfer loads from the hammer insert to the frame.

2. A handgun according to claim 1, wherein the frame is fitted with a front guide insert configured for fixedly arresting within the frame.

3. A handgun according to claim 2, wherein the front guide insert is removable about an axis substantially perpendicular to the longitudinal axis of the barrel of the firearm.

4. A handgun according to claim 2, wherein the hammer insert is configured at a front thereof with a front guide arresting portion arresting a corresponding arresting portion of the front guide, substantially eliminating axial displacement therebetween.

5. A handgun according to claim 1, wherein the hammer insert is detachably attachably secured within a receiving portion at a rear of the frame.

6. A handgun according to claim 1, wherein the frame is over-molded over the hammer insert, such that the hammer insert is fixedly integrated within the rear portion of the frame.

7. A handgun according to claim 6, wherein the hammer insert is configured with depressions and/or protrusions laterally extending from side walls thereof, for fixedly arresting within the frame molded there over and transferring loads from the hammer insert to the frame.

8. A handgun according to claim 1, wherein the hammer insert has a rear shape mimicking the corresponding shape of a solid frame firearm, however blending flush with the contour of the firearm.

9. A handgun according to claim 1, wherein the hammer insert is configured with bilateral guide rail segments coextensive with bilateral guide rail segments configured at the frame or a front guide.

10. A handgun according to claim 9, wherein arresting between the front guide and the hammer insert can take place by a male portion downwards projecting at a rear bottom portion of the front guide and configured for arresting within a corresponding female portion at a top front portion of the hammer insert.

11. A handgun according to claim 1, wherein the hammer insert is configured with a front guide engaging portion, which at an assembled position abuts the front guide.

12. A handgun according to claim 1, wherein the hammer insert is configured with a frame positioning and engaging fitting cooperating with a corresponding hammer insert positioning and arresting fitting.

13. A handgun according to claim 12, wherein the frame positioning and engaging fitting is configured as a pair of lateral groves or lateral projecting shoulders and the hammer insert positioning and arresting fitting is configured as another one of said pair of lateral groves or lateral projecting shoulders.

14. A handgun according to claim 1, wherein the hammer insert is configured for sliding positioning within the frame and is displaceable about an axis substantially parallel to an axis of a barrel of the handgun.

15. A handgun according to claim 1, wherein the hammer insert is secured to the frame by one or more fasteners extending about an axis perpendicular to the axis of the barrel of the handgun.

16. A handgun according to claim 15, wherein the one or more fasteners extend through the handgrip portion of the handgun.

17. A handgun according to claim 1, wherein a hammer of the handgun is pivotally coupled to the hammer insert.

18. A handgun according to claim 1, wherein the hammer insert is configured for bearing loads imparted thereto by the hammer along an axis transverse the axis of the barrel of the handgun.

* * * * *